United States Patent [19]

Nishihara et al.

[11] 4,445,350

[45] May 1, 1984

[54] EXTRUSION METHOD USING HOT LUBRICANT

[75] Inventors: Masao Nishihara, Kyoto; Tomiharu Matsushita, Nishinomiya; Masataka Noguchi, Nishinomiya; Kazuo Arimura, Akashi; Akira Ohte, Kobe; Tetsuo Kimura, Kitakyushu; Akira Iwai, Kitakyushu; Nobuo Hayashida, Kitakyushu, all of Japan

[73] Assignee: Kabushiki Kaisha Kobe Seiko Sho, Kobe, Japan

[21] Appl. No.: 325,552

[22] Filed: Nov. 27, 1981

[30] Foreign Application Priority Data

Nov. 29, 1980 [JP] Japan ..... 55-169908

[51] Int. Cl.[3] ..... B21C 23/32

[52] U.S. Cl. ..... 72/38

[58] Field of Search ..... 72/38, 39, 41, 42, 43, 72/253.1, 342, 364

[56] References Cited

U.S. PATENT DOCUMENTS

| | | | |
|---|---|---|---|
| 3,164,253 | 1/1965 | Muller | 72/38 X |
| 3,349,593 | 10/1967 | Scheil | 72/38 |
| 4,192,162 | 3/1980 | Zilges et al. | 72/38 X |

FOREIGN PATENT DOCUMENTS

| | | | |
|---|---|---|---|
| 279310 | 3/1970 | Austria . | |
| 1182193 | 11/1964 | Fed. Rep. of Germany . | |
| 2284380 | 4/1976 | France | 72/253.1 |

*Primary Examiner*—E. Michael Combs

*Attorney, Agent, or Firm*—Oblon, Fisher, Spivak, McClelland & Maier

[57] ABSTRACT

There is disclosed a method for hot lubricated metal extrusion in which a billet is extruded into a solid or tubular form by means of a die and/or a mandrel with an organic lubricant interposed within a container, the method comprising feeding a combustion improver or a mixture of a combustion improver and water into an extruded product thereby burning off the carbide of the lubricant deposited on the surfaces of the extruded product.

4 Claims, 8 Drawing Figures

PRIOR ART

EXTRUSION METHOD USING HOT LUBRICANT

BACKGROUND OF THE INVENTION

This invention relates to a method for extruding solid or tubular products using a hot lubricant, including means for removing the deposit of carbonized lubricant on the surface of each extruded product in a reliable and easy manner simultaneously with the extruding phase of operation thereby improving the quality of the extruded products and facilitate the aftertreatments thereof.

There are known in the art various methods for producing solid or tubular bodies by metal extrusion, including the non-lubricated extrusion which is widely used for non-ferrous materials (e.g., aluminum and copper alloys). Also known are the extrusion with a glass lubricant and the extrusion with a carbon-base lubricant which are used mainly for steel materials, or the hydrostatic extrusion which is applicable to a wide variety of metallic materials. It is also known that the extrudability of a non-ferrous metal material can be improved to a significant degree by the use of the carbon-base lubricant extrusion or the hydrostatic extrusion method. For example, with a given press power, it becomes possible to work a billet at a higher reduction rate or to work a billet of a lower temperature. In the case of an aluminum alloy material, it is possible to enhance the productivity by speeding up the extrusion without incurring defects. However, these extrusion methods invariably have a problem in that the quality of the products is greatly impaired by the carbonized lubricant which deposits on the surfaces of the extruded products. For instance, the lubricated extruding means in which a billet precoated with a carbon-base lubricant is loaded into a container after heating and extruded through a die and/or a mandrel or in which the container as well as the die and/or mandrel is anointed with a carbon-base lubricant prior to loading a heated billet in the container for extrusion and the hydrostatic extrusion means in which a hot billet loaded in a container is extruded by the pressure medium applied to the ambient of the billet (with the forced lubricating effect of the pressure medium) have a common problem in that the surfaces of the extruded tubular product are darkened due to the deposition of a carbide of the used lubricant, which is formed by the extrusion at a high temperature. The carbide deposit on the extruded product not only lowers its value but also causes a corrosion when the tubular product is used as a condensor tube of a heat exchanger or the like. The deposit of carbonized lubricant gives rise to a similar problem even when an iron-base material is extruded with the use of a carbon-base lubricant. Although the carbide deposit on the outer surfaces of the solid or tubular extrudate are removed in a case where the extruded tube or rod is drawn through a drawing die in a subsequent stage, it is difficult to wash off the carbide deposit from the inner surfaces of the tube by pickling or the like. In addition, as the diameter of the tube or rod is reduced in the drawing stage, the pickling operation, which is troublesome in itself and requires complicated operations for the disposal of the spent liquor, should be avoided if possible from the standpoint of productivity and economy. Especially where a narrow tube of about 10–30 mm in diameter and in excess of 700 mm in length is extruded, it is practically difficult to remove the deposits on the inner surface of the extruded tube completely by a pickling a similar treatment. Therefore, a need still exists for long and thin tubes having clean inner surfaces after extrusion. In the absence of appropriate technology, there is a strong demand for a technical solution to this problem.

SUMMARY OF THE INVENTION

It is an object of the present invention to provide a means for burning off the deposits of carbide which occurs on the surfaces of an extruded body in hot lubricated metal extrusion. It is a further object of the present invention to provide a method for hot lubricated extrusion of tubular bodies through a space defined by a die and a mandrel while applying an organic lubricant between the mandrel and a billet, in which a combustion improver or a mixture of a combustion improver and water is fed into the tubular product to burn off the carbide of the lubricant which otherwise tends to deposit on the inner surfaces of the extruded tubes. It is another object of the present invention to provide a method of hot lubricated extrusion of a solid or a tubular material, in which a combustion improver is fed to the outer surface of extruded material to burn off the carbide and the water is brought into contact with the material thereafter to cool the material and prevent oxidation of the surface.

The above and other objects, features and advantages of the present invention will become apparent from the following description and the appended claims, taken in conjunction with the accompanying drawings which illustrate by way of example preferred embodiments of the present invention.

PARTICULAR DESCRIPTION OF THE INVENTION

Figure 1:
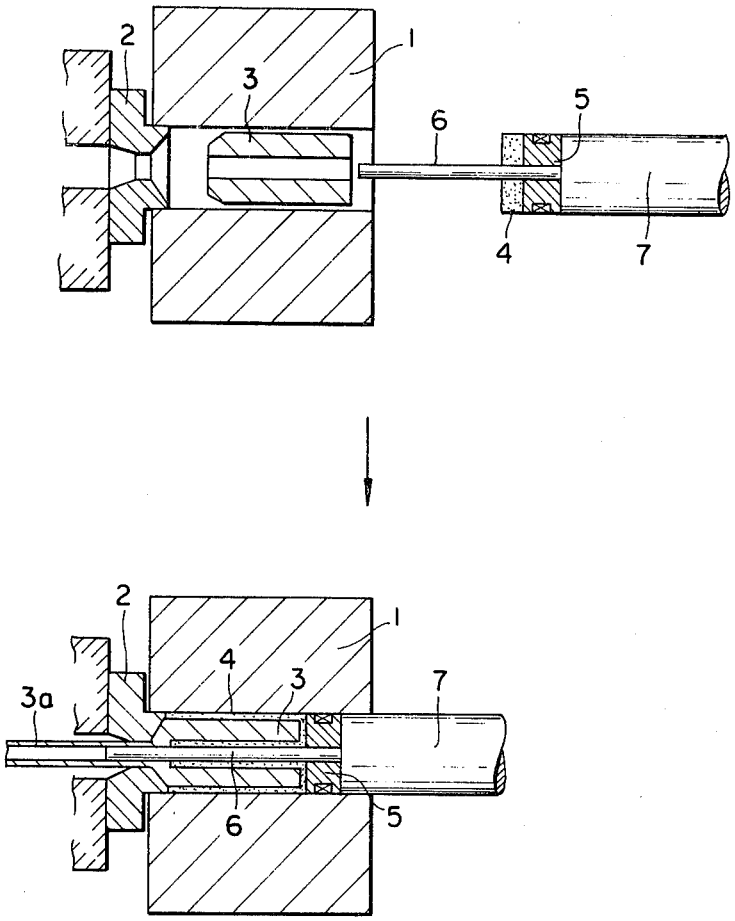
FIG. 1 is a diagrammatic illustration of one example of the conventional static pressure extrusion.
Figure 2:
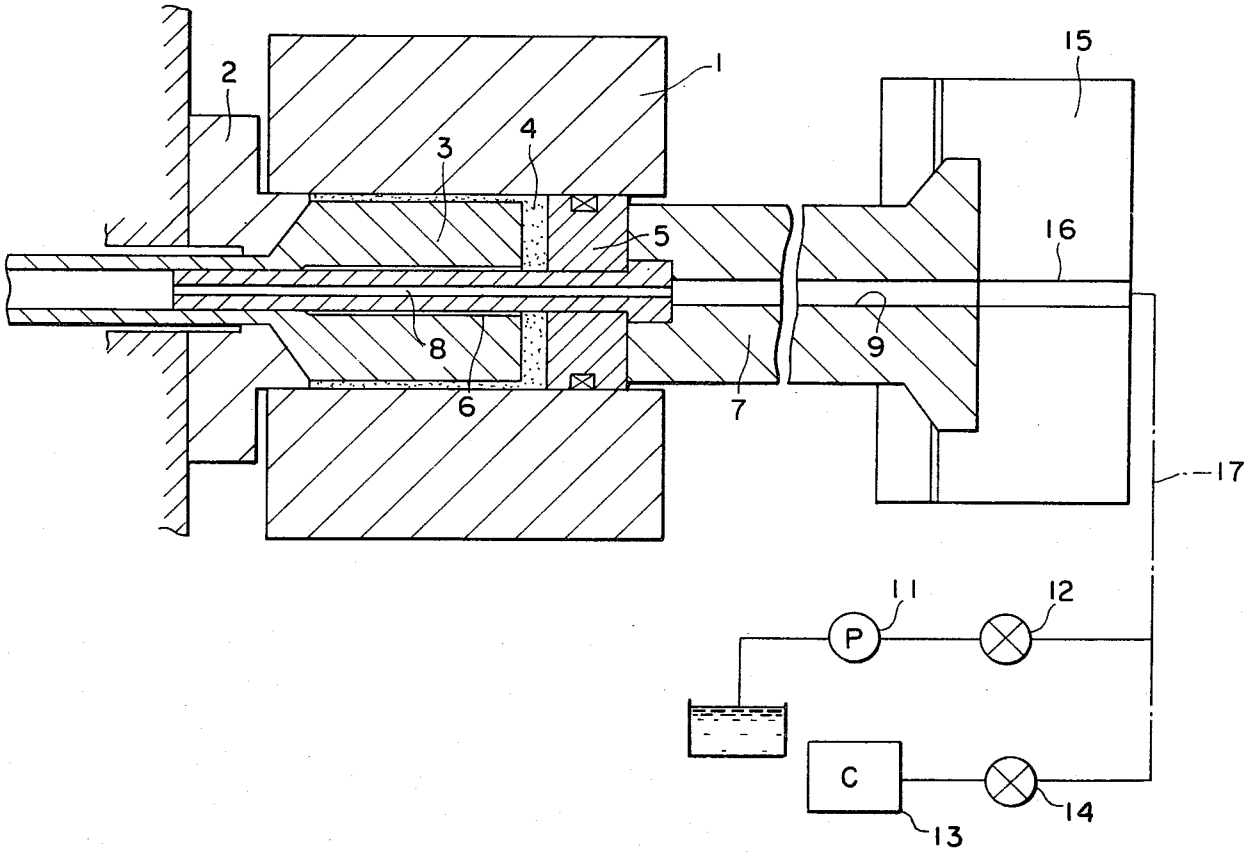
FIG. 2 is a diagrammatic illustration of one embodiment of the invention as applied to similar hydrostatic extrusion.

Referring now to the accompanying drawings, FIGS. 1 and 2 illustrate a conventional hydrostatic extrusion and a similar hydrostatic extrusion incorporating the method of the present invention, respectively. In the hydrostatic extrusion, a hot hollow billet 3 which is heated to a high temperature of 500° C. or more is loaded in a container 1 and a pressure medium 4 like a commercially available non-soap group grease, liquid polymer or the like is set on the mandrel 6 which is projectingly located at the fore end of a press stem 7 through a seal piston 5, filling the pressure medium 4 around the hollow billet 3 by displacement of the stem 7 to extrude a tubular product 3*a* through a space defined between the mandrel 6 and a press die 2, as shown in FIG. 1. In this instance, the pressure medium 4 sticks on the extruded billet and forms deposits of carbide on the inner and outer surfaces of the tubular product 3*a* which is extruded at a high temperature. In the case of the ordinary hot lubricated extrusion which does not employ the pressure medium 4, the hollow billet 3 is precoated with a carbon-base lubricant and heated before charging same into the container 1, and then extruded into a tubular form 3*a* through the mandrel 6 and die 2. Alternatively, a heated hollow billet 3 is charged into the container 1 after precoating the carbon-base lubricant on the container 1, mandrel 6 and die 2 and similarly extruded into a tubular form 3*a* through the mandrel 6 and die 2. In either case, the carbide of the lubricant deposits on the outer surfaces of the extruded tubular product in a manner similar to the hydrostatic extrusion. The deposition of the carbonized lubricant or pressure medium which lowers the quality of the product and causes corrosive degradation as mentioned before should be removed completely.

In the hot lubricated extrusion where an organic lubricant and pressure medium are interposed between the mandrel 6 and billet 3 and the tubular product 3*a* is extruded through the space defined by the die 2 and mandrel 6, the present invention succeeded in completely burning off the lubricant and pressure medium which is extruded along with the tubular product through the gap between the mandrel 6 and billet 3, by injecting a combustion improver or a mixture of a combustion improver and water into the tubular product which is being extruded. FIG. 2 depicts a hot lubricated extrusion incorporating the method of the present invention, in which a container 1, die 2, hollow billet 3, pressure medium 4, seal piston 5, mandrel 6 and stem 7 are arranged substantially in the same manner as in FIG. 1. However, according to the present invention, an axial through hole is provided centrally in the mandrel 6 thereby to feed a combustion improver or a mixture of a combustion improver and water as shown in FIG. 2. For the supply of the combustion improver or a mixture of a combustion improver and water, through holes 9 and 16 are further provided in communication with the through hole 8, in the stem 7 which holds the mandrel 6 and in a crosshead 16 which is movable back and forth together with the stem 7. Air, which is used as one of the combustion improvers, is fed to the supply passage 17 through a valve 14 either alone or together with water which is fed from a pump 11 through a valve 12.

Although various kinds of materials can be used as a combustion improver in the present invention, it is preferred to employ a combustion improver in the form of a gas in view of the easiness of controlling the operation of feeding the improver continuously from outside into the extruded tubular product through the axial through holes in the mandrel 6 and stem 7 or other components of the press. Particularly, it is preferred to use the atmosphere (air) which is easily available and advantageous from the standpoint of cost and safety.

Although the use of a combustion improver alone can attain the purpose of the present invention, the use of water in combination with the combusiton improver serves to cool the mandrel by forming a mist when the combustion improver is in the form of a gas like air. Even in a case where the combustion improver is fed in a mist form to cool off the tube, the carbide deposits on the inner surface of the tubular product is burned off immediately upon extrusion thereof so that the temperature drop of the tube does not hinder the removal of the carbide. In the embodiment depicted in FIG. 2, the required air in compressed form is fed from an air compressor 13 into the extruded tube through the air supply passage 17 and axial through holes 16, 9 and 8. At this time, the air is slightly heated during passage through the mandrel 6 by absorbing the heat of the latter, to a level higher than 50° C., while the hollow billet 3 is heated to 500° C. -1150° C. prior to loading same into the container 1 and extruded at a stem speed of 40–50 mm/sec. The combustion improver air which is supplied in this manner reacts with the lubricant or pressure medium 4 which is extruded together with the tubular product 3*a* through the gap between the mandrel 6 and billet 3, thus completely burning off the lubricant or pressure medium by the heat of the extruded tubular product 3. In this instance, if the tubular product is extruded at a low temperature, it is necessary to select a suitable lubricant or pressure medium. In the hydrostatic extrusion as depicted in FIG. 1 or in the ordinary hot lubricated extrusion using a die and a mandrel alone without intervention of a pressure medium, it is possible to obtain tubular products 3*a* with inner surfaces free of carbide deposits by feeding compressed air into the extruded tube from the air compressor 13 through the mandrel 6 in either case. More specifically, in the case of the ordinary hot lubricated extrusion, a hollow billet of pure copper, for example, may be extruded under a condition in which carbide deposition appears on the inner surfaces of the tube. In other words, the copper billet may be precoated with an organic solvent type carbon lubricant and heated to a temperature over 500° C. before charging it into the container. On the other hand, in the case of the hydrostatic extrusion, a billet heated similarly to a temperature above 500° C. may be charged into the container and extruded by means of a commercially available pressure medium such as the non-soap group grease containing an inorganic compound as a tackifier in a mineral oil or a viscous liquid polymer. In the metal extrusion where the temperature of the billet is lower than 500° C., it is preferred to employ a viscous liquid polymer as a pressure medium for hydrostatic extrusion. However, whichever extruding method may be resorted to, the complete burn-off of the lubricant or pressure medium by air or other combustion improver which is fed into the extruded tubular product through the axial hole 8 in the mandrel according to the present invention can be applied to billets of an extremely broad temperature range.

Where the combustion improver is in the form of a gas like air as in the above-described embodiment, it should be fed at such a rate that the oxygen content in the gas is sufficient for completely burning off the lubricant or pressure medium which is extruded along with the billet 3 through the gap between the mandrel 6 and billet 3. In this connection, it has been experimentally confirmed that, in an extruded tubular product 3*a* bears on its inner surface closely deposited amorphous carbon particles in a thickness of 0.3–0.5 microns. Therefore, it suffices to feed oxygen in a quantity which is suitable for completely burning off the 0.5 micron thick amorphous carbon deposit but it is preferred that air which contains a greater amount of oxygen should be supplied in actual applications for reliable and stable operations. If the combustion improver is used in a mist form, water in a reservoir or tank 10 is fed by a pump 11 through a valve 12 as shown in FIG. 2 and mixed under increased pressure with the compressed air from the air compressor 13, supplying the mist into the axial through hole 8 of the mandrel 6 through the supply passage 17 and axial passages 16 and 9. In this instance, the misty combustion improver gas is fed also into the tubular product being extruded as mentioned hereinbefore and its accelerated cooling effect on the extruded tube causes no problem since the carbide on the inner surfaces of the extrudate is burned off immediately upon extrusion.

For burning off the carbide deposits on the inner surfaces of the tubular extrudate by feeding a combustion improver such as oxygen or air or a mixture of a combustion improver and water according to the present invention, it is necessary to take into consideration the oxidation phenomenon of the metal material which constitutes the hollow billet. For example, where the extruding metal is aluminum, brass or other metals which are less susceptible to oxidation, there occurs no problem even if a more than predetermined amount of combustion improver gas (e.g., oxygen, air) is supplied for complete combustion of the carbide deposits, excess oxygen just lingers in the tubular extrudate after the complete combustion of the carbide deposits. In contrast, copper-based materials, particularly, pure copper and cupro-nickel are very susceptible to oxidation although brass is relatively immune from oxidation. In the case of brass, oxygen which is fed in an excess amount remains in the tube after complete combustion of the carbide deposits without reacting with the metal or released from the fore end of the extruded tube 3*a* , so that the inner surfaces retain a clean brass color. However, with pure copper or cupro-nickel, the excessive oxygen supply causes production of an oxidation film on the base metal by reaction with the residual oxygen which lingers in the tube after complete combustion of the carbide deposits. This also occurs to brass if oxygen is supplied in an extremely excessive amount. In actual operations, the existence of a slight oxidation film or a thin drawable film of $Cu_2O$ is permissible, which however turns into CuO if oxygen is supplied in an excess amount. In the extrusion of copper or copper alloy tubes, the production of the oxidation film of CuO causes deteriorations in the surface properties in the drawing stage, and it is difficult to remove it by reduction in the bright annealing which is usually effected subsequent to the drawing. Therefore, the feed rate of the combustion improver should be so controlled as not to produce the oxidation film of CuO.

With regard to the feed rate of the combustion improver or the mixture of the combustion improver and water, the present invention as a result of several experiments and studies succeeded in establishing effective and reliable principles common to each of the cases where the billet is a ferrous metal and where it is a non-ferrous metal. More particularly, the carbide (of the lubricant or pressure medium) which deposits on the inner surfaces of the tubular extrudate 3*a* through the gap between the mandrel 6 and billet 3 is completely burned off in the region to which the combustion improver such as oxygen and air is blown in from the inner end of the axial through hole 8 or the mandrel 6. Most ideally, the combustion improver should not remain even in small amounts in the tube which has passed the "combustion region" in order to manufacture a sound tubular product 3*a* the inner surfaces of which are completely free of combustible carbide and which is immune from the oxidation of the base metal. However, in actual operation, the combustion improver still remains in the tube which has passed the combustion region and reacts with the base metal to form objectionable oxidation film, the oxidation reaction terminating when the combustion improver becomes scarce by the formation of the oxidation film. After passage through the oxidation region where such oxidation reaction takes place, no oxidation occurs to the base metal, that is to say, the combustion and oxidation regions exist over limited lengths from the extruding position (the outlet of the die), irrespective of the length of the extruded product 3*a*. Thus, it is possible to effect the complete combustion of the combustible carbide as intended by the present invention and to permit the oxidation reaction only in an unobjectionable degree by controlling the feed rate of the combustion improver to the outlet of the axial passage 8 of the mandrel 6. If the billet extruding speed (cm/sec) is V and the inner diameter (cm) of the extruded product is d, the feed rate Q of the combustion improver for sound extrusion is commonly in the range defined below, which is effectively applicable no matter whether the billet is a non-ferrous metal like a cuprous metal or a ferrous metal, e.g. carbon steel (S45C), or the like. It has been experimentally confirmed that this method is effective especially for the extrusion of a billet of copper or a copper alloy using air as the combustion improver. The abovementioned suitable range of the combustion improver feed rate Q is $$1.8d \cdot R \cdot V \leqq Q \leqq 14.2d \cdot R \cdot V$$

where the feed rate Q is in the unit of 1/min.

Further, in actual operations, it is necessary to control suitably the time points of starting and stopping the feed of the combustion improver in the manner as described hereinafter. The feed of the combustion improver should be cut off when the extruding speed becomes zero upon completion of extrusion of the tubular product 3*a*. If the feed is cut off with a time delay at the time of completion of extrusion, the localized oxidation takes place due to the existence of excess oxygen as mentioned before and the oxidized area extends toward the fore end of the tubular product 3*a*. However, a slight time delay should desirably be allowed in the actual operation. In order to meet this requirement, we conducted experiments on the feed periods of the combustion improver in the extruding operations, and found that, if the start of its feed is begun after the start of actual extrusion of the tubular product 3*a* , deposits of combustible carbide occur at the fore end of the extruded tubular product 3*a* due to the delay, although no influence of time lag is observed when the feed of the combustion improver is started earlier than the initiation of the extrusion. Therefore, it is suitable to open the valve 14 in the feed passage 17 or valves 14 and 12 in the pressing (pressure-increasing) phase of the press to feed the combustion improver before the extrusion of the tubular product 3*a* is initiated. With regard to the time at which the combustion improver should be stopped, the combustion of the carbide in the extruded tubular product 3*a* becomes incomplete if it is cut off before the extrusion is completed, resulting in deposits of combustible carbide at the rear end of the extruded product. On the other hand, if the feed of the combustion improver is delayed an oxidation film is formed at the rear end of the product in conspicuous degree due to the supply of excess oxygen. Therefore, the feed of the combustion improver should be controlled in a suitable time range not to lower production yield, and in actual operations should suitably be stopped within a time range from one second before the termination of the extrusion of the tubular product 3*a* to 5 seconds after the termination of the extrusion thereof.

In the extrusion of a billet of a metal which is unsusceptible like aluminum and brass as mentioned hereinbefore, there is no possibility of impairing the quality of the extruded product even if the time for stopping the feed of the combustion improver is largely delayed after termination of the extrusion, and a suitable feed time range should be determined in connection with the time period of the press cycle.

Alternatively, for completely burning off the combustible carbide by feeding air as a combustion improver through the mandrel 6, the billet may be extruded under a condition in which a slight oxidation film is formed on the inner surface of the extruded tube by residual oxygen then, lessening the thus formed oxidation film by feeding through the mandrel 6 a DX gas (2.85% CO, 1.99% H, 11.9% CO and the balance of N) in the succeeding cooling phase of the tubular product 3*a*. Since the DX gas is fed after termination of the extrusion, it is necessary to maintain the tubular product 3*a* in a temperature range suitable for the reducing reaction. In the case of extrusion of an elongated product, there is still a need for studying the cooling characteristics of the tubular product and controlling its temperature accordingly. Further, when it is expected that there is a possibility of the residual oxygen remaining in the tubular product 3*a* after its extrusion thereby causing the oxidation reaction upon a drop in the temperature of the tubular product (due to the peculiar characteristics of the oxidation reaction), the residual gas in the extruded tube may be replaced by a non-oxidative gas such as an inert gas or reducing gas for the quality control of the product if desired.

Tables 1 to 3 illustrate the results of more specific extruding experiments according to the method of the present invention as compared with the conventional method.

TABLE 1

| Extruding Material | Extruding Conditions: Extrud. rate | Billet temp. °C. | Extrud. speed mm/sec | Inner tube diam. mm | Air feed l/min | Quality Evaluation W/ or W/o air supply: w/air | w/o air |
|---|---|---|---|---|---|---|---|
| Pure copper | 60 | 700 | 40 | 19.5 | 120 | Clean in extruded state and took metallic gloss by 40% drawing | |
| Aluminum brass | 60 | 800 | 40 | 19.5 | 300 | With metallic gloss in extruded state | Dark carbide deposit over entire surface |
| Cupro-nickel (10% Ni) | 35 | 900 | 40 | 19.5 | 82 | Same surface color as base metal in extruded state | |
| Carbon steel | 23 | 900 | 50 | 19.5 | 150 | No carbide deposit on extrudate but thin oxidation film | |

TABLE 2

Air Feed Rate & Inner Surface Quality in Extrusion of Pure Copper

Extruding conditions:

| | |
|---|---|
| Billet temperature | 700° C. |
| Extrusion rate | 60 |
| Extruding speed (stem) | 40 mm/sec |
| Inner diameter of tube | 19.5 mm $\phi$ |
| Tube length | 5 m |

| Air feed rate l/min | h value | Properties of extrudate inner surface: Carbide deposition | Production of Brown oxidation film | Oxidation film Dark oxidation film | Quality Evaluation |
|---|---|---|---|---|---|
| 0 | 0 | Entire surface darkened | — | — | Difficult to remove carbide |
| 40 | 1.4 | Entire surface slightly darkened | | | |
| 50 | 1.8 | None | Invisible with eyes Sound material with thin film with thick film | None | Acceptable as commercial product after cold drawing & bright annealing |
| 60 | 2.1 | | | | |
| 120 | 4.3 | | | | |
| 200 | 7.1 | | | | |
| 300 | 10.7 | | | | |
| 400 | 14.2 | | | | |
| 450 | 16.0 | None | | Dark oxidation | After treatment |

TABLE 2-continued

| Air Feed Rate & Inner Surface Quality in Extrusion of Pure Copper | | |
|---|---|---|
| | film | difficult |

TABLE 3

Air Feed Rate & Inner Surface Quality in Extrusion of Cupro-Nickel (10% Ni)

Extruding Conditions:

| | |
|---|---|
| Billet temperature | 900° C. |
| Extrusion rate | 35 |
| Extruding speed (stem) | 40 mm/sec |
| Inner diam of tube | 19.5 mm $\phi$ |
| Length of tube | 5 m |

Properties of extrudate inner surface

| Air feed rate l/min | Air feed rate h value | Carbide deposition | Production of Brown oxidation film | Oxidation film Dark oxidation film | Quality Evaluation |
|---|---|---|---|---|---|
| 0 | 0 | Deposition on entire surface | — | — | Difficult to remove |
| 25 | 1.5 | Thin spots | — | — | |
| 33 | 2.0 | None | Invisible with eyes | | |
| 41 | 2.5 | | | | |
| 82 | 5.0 | | Sound material | | Acceptable as commercial products after cold drawing & bright annealing |
| 123 | 7.5 | | | | |
| 164 | 10.0 | | | None | |
| 172 | 10.5 | | | | |
| 180 | 11.0 | | With thin film | | |
| 230 | 14.0 | | With thick film | | |
| 254 | 15.5 | None | — | Dark oxidation film | Pickling necessary |

The invention in which carbide on inner surface of the tubular extruded material is burned off has been discussed. However, this is not all what we claim in this application.

According to the other embodiment of the present invention, deposited carbonized lubricant on outer surface of extruded material (solid or tubular material) is removed therefrom by feeding combustion improver to the outer surface of the extruded material which leaves extrusion die, and bringing coolant liquid into contact with the outer surface of the material after carbonized lubricant is burned off. The carbonized lubricant remaining on the outer surface is thus completely removed and oxidation film formation is prevented. Furthermore, crystal grain growth of the extruded products can also be suppressed.

When a copper alloy billet is extruded with heat resisting lubricant, the thickness of the carbonized lubricant retained of the outer surface of the extruded tube is at most 1.4 $\mu$m.

In order to burn off the carbonized lubricant, optimum amount of combustion improver is fed to the extruded material while the material is still hot. If the amount of combustion improver to be fed is insufficient, carbide adhesive will remain on the outer surface. If the amount of combustion improver is too much, oxidized film is formed on the outer surface of the extruded material.

In order to obtain optimum conditions for feeding combustion improver, i.e. amount of combustion improver and period for feeding the same, various experiments were conducted under the following extrusion conditions.

[Extrusion Conditions]

Billet—Cupro-nickel (68 mm in diameter, 200 mm in length).

Heating temp. of a Billet—900° C.

Extrusion Speed—2 m/sec. and 4.4 m/sec. (product)

Extrusion Ratio—40 and 113.

Combustion Improver—Air (Atmosphere)

Figure 3:
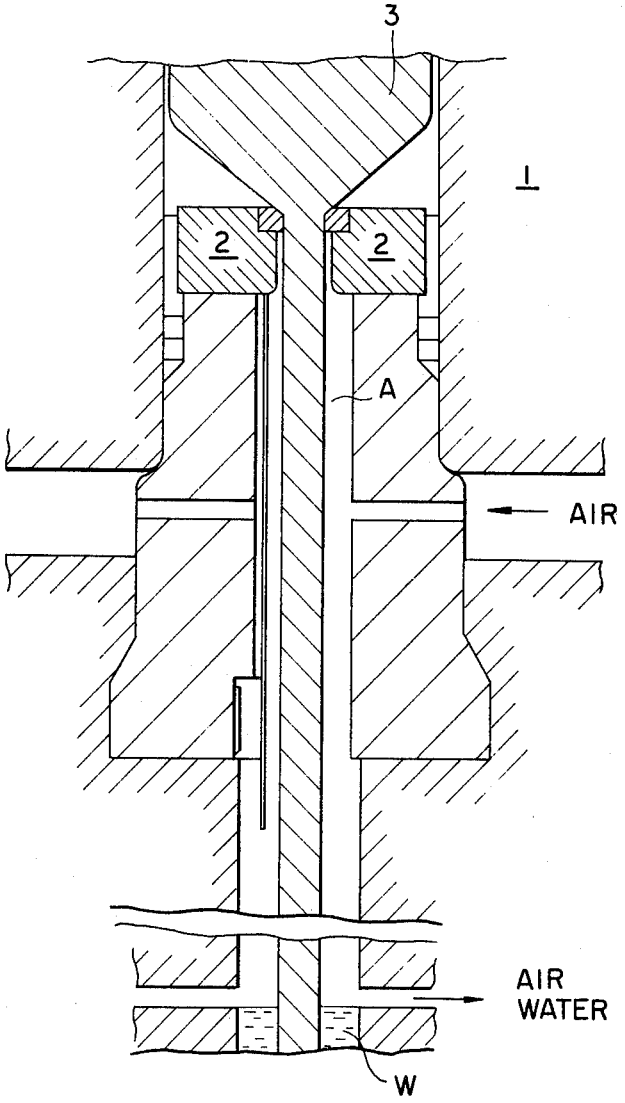
FIG. 3 is a diagrammatic illustration of another embodiment of the invention as applied to hydrostatic extrusion.

FIG. 3 is a diagrammatic representation of an apparatus for carrying out the method of the invention. Air feeding zone A is provided at the downstream of the extrusion die 2 so that air is brought into contact with the outer circumference of the extruded material. Water cooling zone W is provided at the downstream of said air feeding zone A, so as to prevent oxidation and to suppress crystal grain growth of the extruded material.

According to the experiments with the abovementioned apparatus under the abovementioned conditions, amount of air feed should be proportionate to the surface area of the extruded material passing through the conbustion zone (air feeding zone) per unit time. Therefore, air feeding rate Q (l/min) can be obtained by the following formula $$Q=K\,D\cdot R\cdot v$$

where K is constant, D is outer diameter of extruded material, (cm), R is extrusion ratio, and v is extrusion speed (stem speed) (cm/sec).

Figure 4:
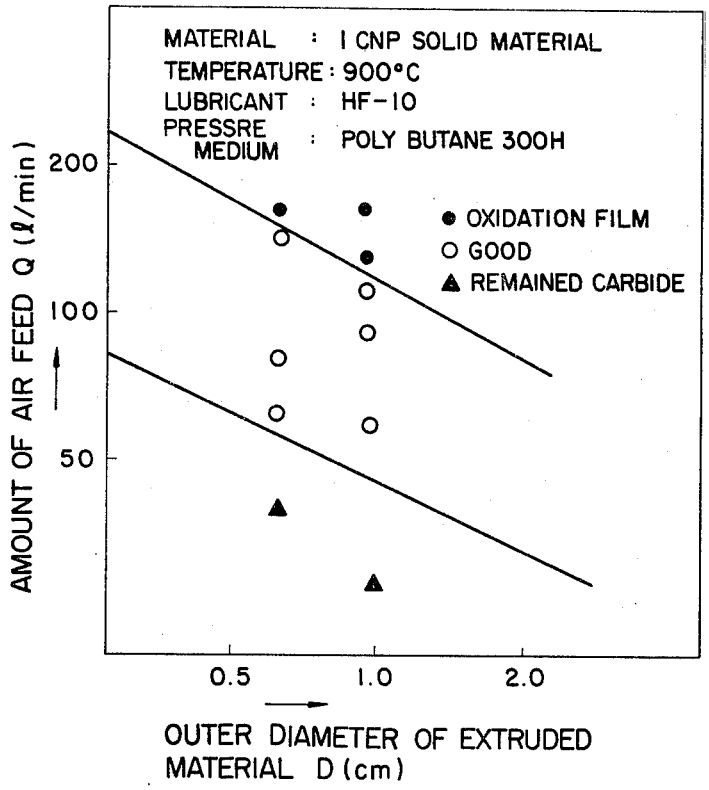
FIG. 4 is a graph showing relationship between the surface quality of the extruded material and the extrusion conditions.

FIG. 4 is a graph showing the relationship between surface quality of the extruded material and the extrusion conditions. More specifically, there is shown a relationship between the amount of air feed (Q) and outer diameter of the extruded material (D). As can be seen from this graph, excess amount of air feed causes formation of the oxidation film on the outer surface of the extruded material. In order to completely remove the carbonized lubricant and to prevent the oxidation on the outer surface of the extruded material, the following condition should be satisfied $$0.3D \cdot R \cdot v \leqq Q \leqq 0.7\ D \cdot R \cdot v$$

Namely, constant K should be from 0.3 to 0.7.

Figure 5:
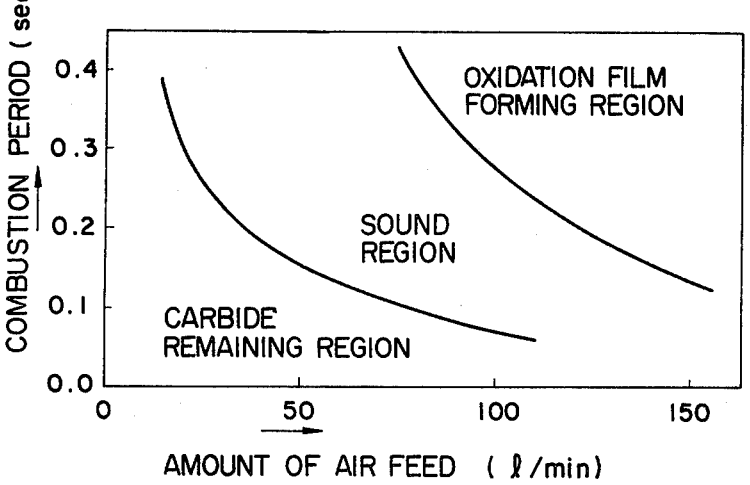
FIG. 5 is a graph showing influence of air feeding condition on the surface quality of the extruded material.

FIG. 5 shows the relationship between time period for the material to pass through air feeding zone and the amount of air feed. The desired period for the material to pass through the air feeding zone varies depending on the amount of air feed, but if the amount of air feed is 140 l/min, the period will preferably be shorter than 0.13 second. If the amount of air feed is 70 l/min, the period will preferably be shorter than 0.35 second. Generally as the amount of air feed becomes less, the period becomes longer during which the extruded material gets cooled, resulting in coarse grains within the extruded material.

Crystal grains of the extruded cupro-nickel tube do not grow even if the tube is slowly cooled in the atmosphere.

However, aluminum brass crystal grains grow rapidly and the surface gets rough when it is drawn. Thus, the length of air feeding zone is considered with aluminum brass.

The extrusion conditions are;

Billet: Aluminum brass (68 mm in outer dia, 200 mm in length)

Billet Heating temperature: 800° C.

Extrusion Speed (extruded product): 1.7 m/s.

Extrusion Ratio: 40

Extruded material size: 22 mm in outer dia. 1.5 mm thick

Combustion Improver: Atmospheric Air 20 l/min.

Figure 6:
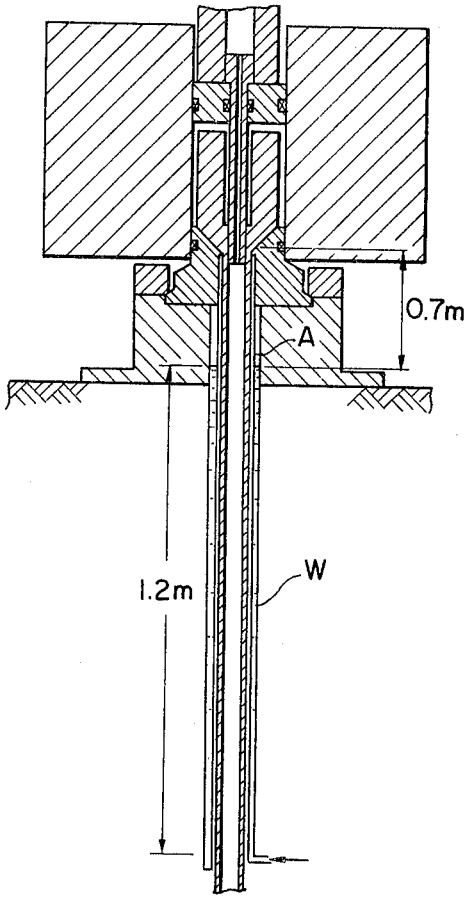
FIG. 6 is a diagrammatic illustration of a hydrostatic extrusion for experimental operation according to the invention.
Figure 7:
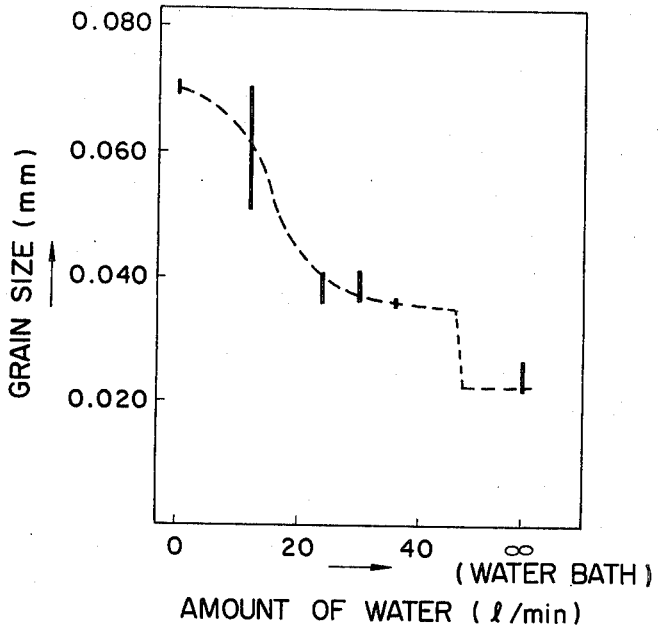
FIG. 7 is a graph showing influence of cooling water on crystal grain size of extruded tube.

The extrusion took place with an apparatus shown in FIG. 6. In this FIG. 6, 0.7 m long air feeding zone A is provided at the outlet side of the extrusion die, and 1.2 m long water cooling zone W is provided at the downstream of said air feeding zone. In order to examine the water cooling effect, amount of water feed was varied from 0 to 36 l/min. The relationship between amount of coolant water and crystal grain size of the extruded aluminum brass is shown in FIG. 7. When the amount of coolant water is 0 l/min, mean grain size of the extruded tube was 0.07 mm. As the amount of water increases, the grain size becomes smaller, and when the amount of water is 20 l/min, the grain size becomes finer than 0.04 mm.

Figure 8:
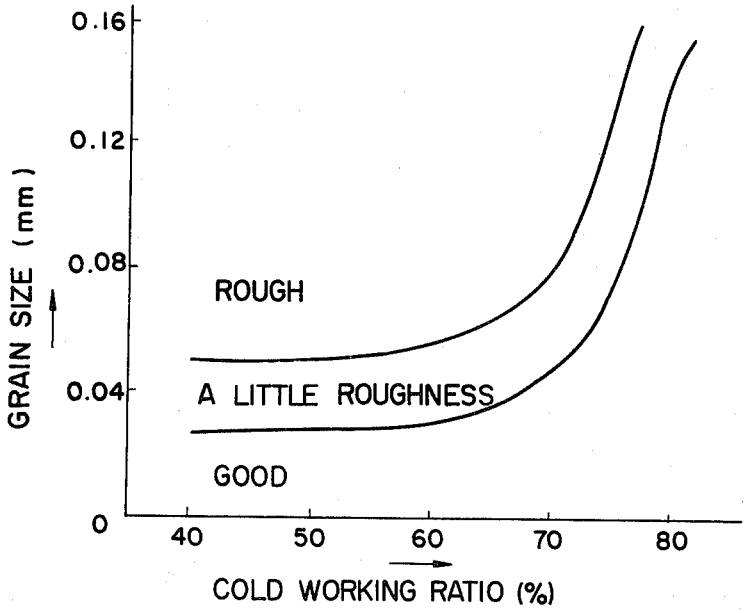
FIG. 8 is a graph showing relationship between crystal grain size of extruded material and cold working rate.

If the extruded tube is subsequently drawn, smoother surface is obtained when the grain size is smaller, as can be seen from FIG. 8. Thus, smooth enough surface can be obtained even after one or two pass drawing if grain size is smaller than 0.04 mm. Therefore, 0.7 m long air feeding zone is very important.

If extrusion speed in terms of extruded material speed is 1.7 m/s, the time period for the material to pass through the air feeding zone is 0.41 second, which is sufficient period for carbonized lubricant to completely burn off as indicated from FIG. 5.

As can be seen from the foregoing description, outer surface of extruded material can be cleaned and grain growth can be suppressed by provision of air feeding zone which is followed by water cooling zone at the downstream of hot hydrostatic extrusion die.

As clear from the foregoing description and the results of experiments, in the conventional hot lubricated extrusion using an organic lubricant in the usual manner between the container and the billet to be extruded, the present invention has particularly excellent effect for completely removing the combustible carbide of the lubricant or pressure medium which tends to deposit on the surfaces of the solid or tubular product, permitting to produce solid or tubular products with clean and defect-free surfaces in a facilitated manner. Especially, according to the present invention, a combustion improver mainly consisting of a combustion improver gas such as oxygen and air or a mixture of a combustion improver and water is fed to the initial billet extruding point of the die and/or mandrel for the complete combustion of the combustible carbide under the high extruding temperature, so that it has become possible to remove the carbide completely and clean the inner surfaces of the tubular product with high reliability. In addition, there can be obtained tubular products with perfect internal surface shapes irrespective of the length of the products to be extruded, and the oxidation of the extruding material can be effectively prevented by adjusting the feed rate of the combustion improver even in the case of a material which is normally susceptible to oxidation, thereby precluding formation of the objectionable oxidation film which is produced by the oxidation reaction. Further this can be attained simply by controlling the feed rate and time period of the combustion improver, without requiring drastic changes in the conventional hot lubricated extrusion system. More specifically, it is possible to produce tubes with sound inner surfaces simply by adding a combustion improver feed passage to the mandrel and providing a combustion improver feed means in association therewith.

Moreover, outer surface of the extruded material can be cleaned by removing carbonized lubricant by means of applying combustion improver. The oxidation and undesired grain growth of the extruded material can be prevented by bringing coolant into direct contact with the outer surface.

What is claimed is:

1. A method for hot lubricated metal extrusion in which a billet of a metal selected from the group consisting of copper and a copper alloy is extruded into a tubular form by means of a die and mandrel with an organic lubricant interposed between said billet and die and mandrel, said method comprising feeding air into the extruded tubular product through a feed passage in said mandrel to burn off the carbide of said lubricant deposited on the inner surface of said extruded tubular product, said air being fed at a rate of Q falling in the range of $1.8d \times R \times V \leqq Q \leqq 14.2d \times R \times V$, wherein d is the inner diameter of the product in cm, R is the extrusion ratio, and V is the billet extruding speed in cm/sec.

2. The method according to claim 1, wherein said air is fed onto the outer surface of said extruded tubular product at a combustion improver feed zone located downstream of an extrusion die, and water is fed onto said outer surface of said extruded tubular product at a water cooling zone located downstream of said combustion improver feed zone, whereby carbide formed from said organic lubricant on said outer surface of said extruded tubular product is burnt off, thereby preventing oxidation and suppressing grain growth on said outer surface of said extruded tubular product.

3. The method according to claim 2, wherein the feeding rate of said air is controlled to satisfy the following condition:

$$0.3D \cdot R \cdot v \leqq Q \leqq 0.7D \cdot R \cdot v$$

wherein Q is the air feeding rate (l/min), D is the outer diameter of extruded material (cm), R is the extrusion ratio, and v is the extrusion speed (cm/sec).

4. The process of claim 1, wherin said air is fed together with water.

* * * * *